US009540222B2

(12) United States Patent
Scott et al.

(10) Patent No.: US 9,540,222 B2
(45) Date of Patent: Jan. 10, 2017

(54) TOOL-LESS TORQUE SETTING FOR A BOTTLE CAPPING HEADSET

(71) Applicants: Michael P. Scott, Midland, MI (US); Thomas F. Pung, Weidman, MI (US)

(72) Inventors: Michael P. Scott, Midland, MI (US); Thomas F. Pung, Weidman, MI (US)

( * ) Notice: Subject to any disclaimer, the term of this patent is extended or adjusted under 35 U.S.C. 154(b) by 448 days.

(21) Appl. No.: 14/259,410

(22) Filed: Apr. 23, 2014

(65) Prior Publication Data

US 2015/0307338 A1 Oct. 29, 2015

(51) Int. Cl.
*B67B 3/20* (2006.01)
*B65B 7/28* (2006.01)

(52) U.S. Cl.
CPC ..... *B67B 3/2093* (2013.01); *B67B 3/2073* (2013.01); *B65B 7/2835* (2013.01)

(58) Field of Classification Search
CPC ..... B65B 7/2835; B67B 3/2073; B67B 3/2093
USPC ..... 53/317, 331.5
See application file for complete search history.

(56) References Cited

U.S. PATENT DOCUMENTS 4,232,499 A * 11/1980 Holstein ..... B67B 3/2073 53/331.5
4,373,358 A * 2/1983 Pearch ..... F16D 7/025 192/111.15
4,662,153 A * 5/1987 Wozniak ..... B67B 3/2073 53/317
6,240,678 B1 * 6/2001 Spether ..... B67B 3/2073 53/317
6,601,285 B1 * 8/2003 Jonker ..... H01R 43/015 29/566.3
7,181,892 B1 * 2/2007 Scott ..... B67B 3/2086 53/317
7,434,370 B1 * 10/2008 Scott ..... B65B 7/2835 192/56.4
7,661,245 B2 * 2/2010 Brown ..... B67B 3/2066 53/317
2007/0214837 A1 * 9/2007 Isalberti ..... C03B 35/10 65/260
2010/0077700 A1 * 4/2010 DeLuca ..... B67B 3/2086 53/331.5
2015/0307338 A1 * 10/2015 Scott ..... B67B 3/2093 53/331.5

* cited by examiner

*Primary Examiner* — Andrew M Tecco
*Assistant Examiner* — Praachi M Pathak

(57) ABSTRACT

A tool-less adjustable torque setting assembly for a bottle capping headset wherein there is a witness mark and a push button. The operator pushes in the button and a tooth on the button's inside surface of the housing disengages with the inside wall of the housing where there are a series of mating teeth. The assembly is rotated to the desired setting and released. The button, which is spring loaded, will return to the seated position in the series of teeth within the housing. No tools are required to adjust the torque setting.

1 Claim, 6 Drawing Sheets

TOOL-LESS TORQUE SETTING FOR A BOTTLE CAPPING HEADSET

BACKGROUND OF THE INVENTION

Capping headsets in general are removed from production or at least taken apart to make adjustment to the torque settings. This is costly because bottle capping is but one aspect of a production line of a product. This results in the loss of money and production time to adjust the torque setting. The present invention overcomes these obstacles.

This application incorporates by reference the following patent applications for what they teach in regard to bottle capping chucks and headsets.

patent application Ser. No. 13/865,256 entitled "Bottle Capping Chucks", filed on Apr. 18, 2013.

patent application Ser. No. 13/445,185 entitled "Dairy Capping Headset and Chuck", filed on Apr. 12, 2012.

patent application Ser. No. 13/136,184 entitled "Bottle Capping Chuck", filed on Jul. 26, 2011.

THE INVENTION

The present invention is a tool-less adjustment assembly for changing a torque setting on a bottle capping headset. The adjustment assembly is comprised of a housing. The housing has an outside edge with an inside surface. A portion of the inside surface has a series of teeth affixed thereon. There is also a snap ring retainer located in the inside surface. There is rotatable, backing plate surmounted on the snap ring. There is a rotatable, adjustable end plate detachably mounted on the backing plate and under the snap ring retainer.

The housing has a witness mark located on the outside surface of the housing opposite the series of teeth. There is a slot within the outside edge of the rotatable, adjustable end plate, and contained in the slot is a spring biased button. This button has a back surface and there is a tooth/or teeth integrated with the back surface. One embodiment has multiple teeth. This single tooth mates with the series of teeth and engages that series of housing teeth to hold the series of teeth in a predetermined position when the button is released.

DETAILED DESCRIPTION OF THE DRAWINGS

Figure 1:
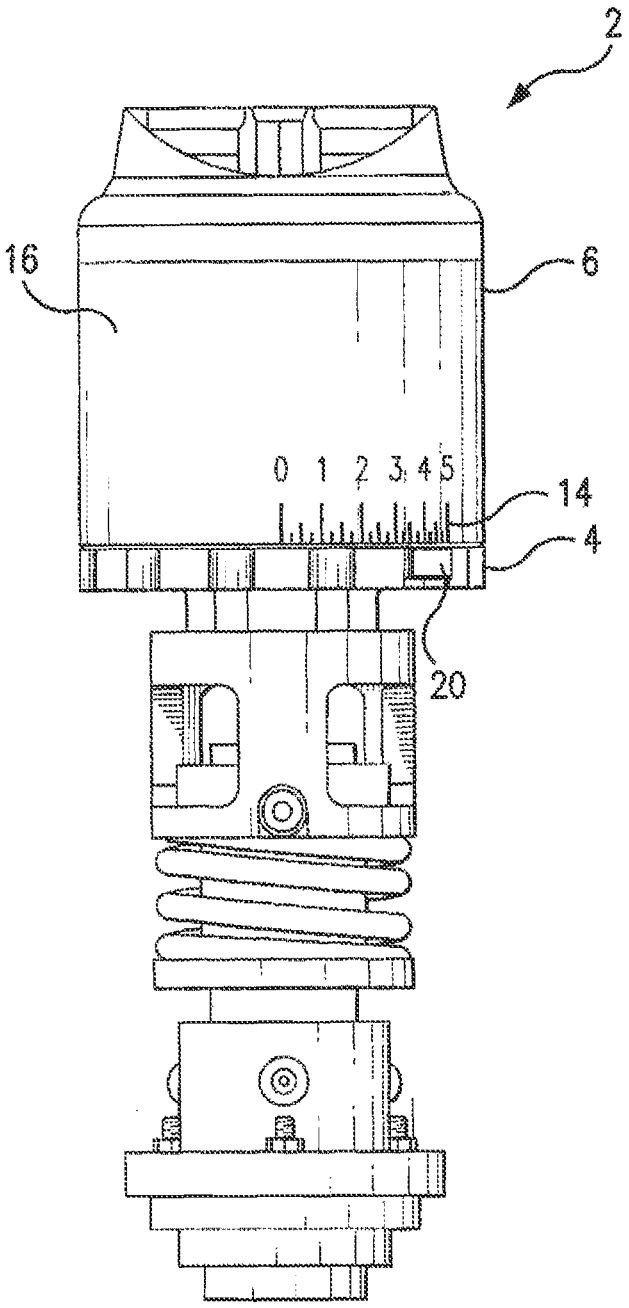
FIG. 1 is a full front view of the capping chuck and headset.

FIG. 1 shows the capping chuck and headset 2 with the tool less adjustment assembly 4 from the front. The adjustable assembly 4 is also referred to as the rotatable, adjustable end plate 4. The present invention allows the capping headset 2 to be adjusted during production by simply pushing in the spring button 20 and adjusting the torque setting, then releasing the spring button 20, resetting the torque in a locked position.

The housing 6 of the capping headset 2 has an outside surface 16. This outside surface 16 contains torque scale witness marks 14 that indicate a relative torque setting that can be applied through the rotation of the adjustment assembly 4 of the capping headset 2.

Figure 2:
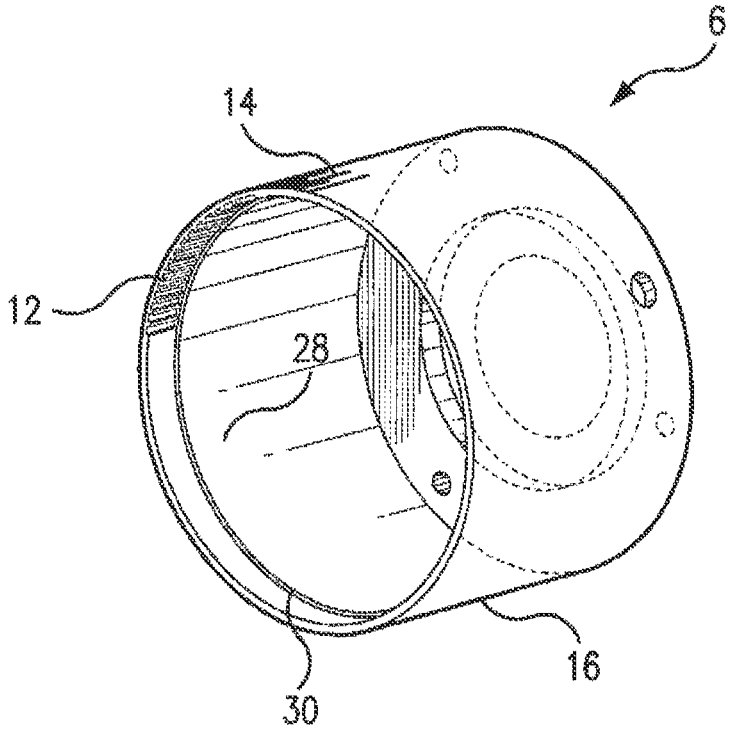
FIG. 2 is a view in perspective of the housing looking at the bottom thereof.

FIG. 2 shows the housing 6 of the capping headset 2. This housing 6 has an outside surface 16. The outside surface 16 contains the witness marks 14. The housing 6 has an inside surface 28 which accommodates a series of teeth 12. Also shown is the snap ring 30 that retains adjustment assembly 4 in the housing 6.

Figure 3:
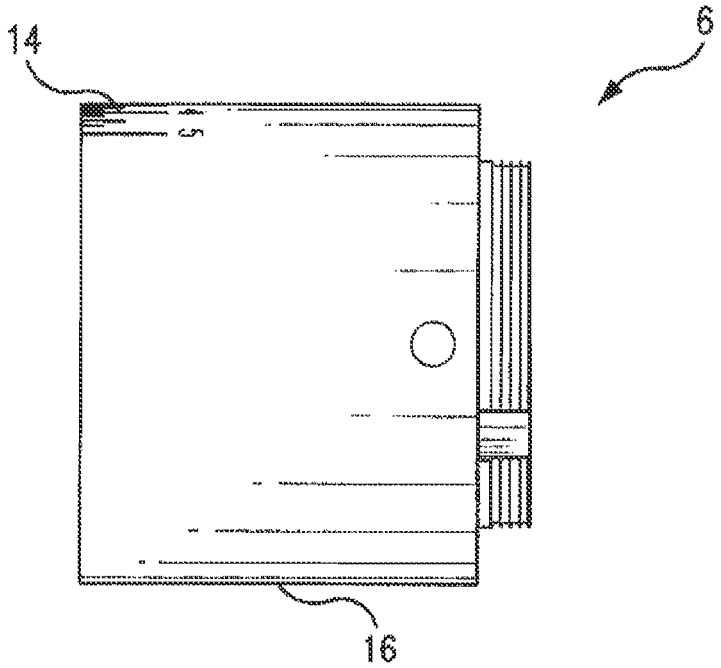
FIG. 3 is a side view of the housing showing a portion of the witness marks.

FIG. 3 shows the housing 6 with the witness marks 14. The outside surface 16 contains the witness marks 14. The witness marks 14 indicate the relative torque setting available to the user. If the capping headset 2 is performing its function with too much torque the user simply pushes in the spring button 20 and turns the tool-less adjustment assembly 4 to reduce the level of torque. The opposite is true if the device 2 has too little torque the user simply pushes in the spring button 20 and turns the tool-less adjustment assembly 4 to increase the level of torque.

Figure 4:
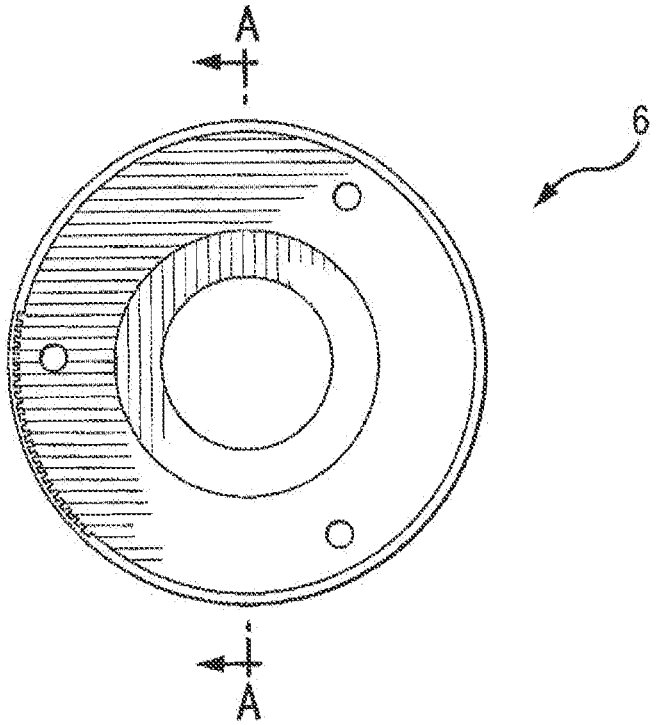
FIG. 4 is full top view of the housing showing the internal components in phantom.

FIG. 4 is a top view of housing 6 with Line A-A through its central point.

Figure 4A:
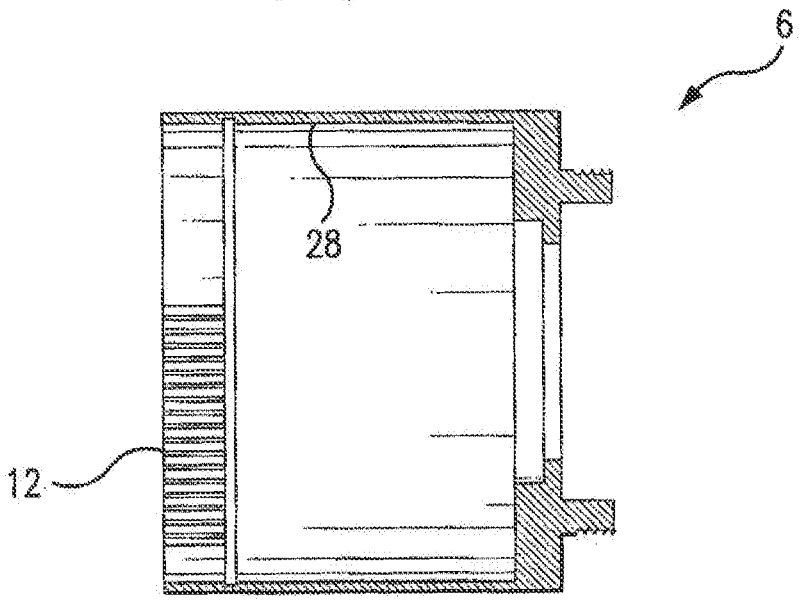
FIG. 4A is a cross sectional view of the housing taken through line A-A of FIG. 4.

FIG. 4A shows the housing 6 and it's inside surface 28 along line A-A. Here the series of teeth 12 are clearly visible.

Figure 5:
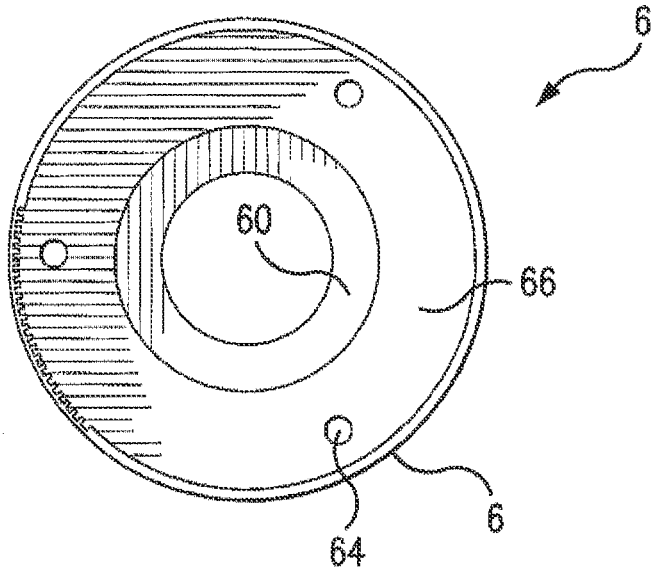
FIG. 5 is an internal view of the inside of the housing from the bottom showing the backing plate within the housing.

FIG. 5 shows the backing plate 60 within the housing 6. The bottom surface 66 of the backing plate 60 has threaded openings 64 therethrough. These openings 64 align with the openings 62 (FIG. 7) of the adjustable assembly 4 to secure one to the other.

Figure 6:
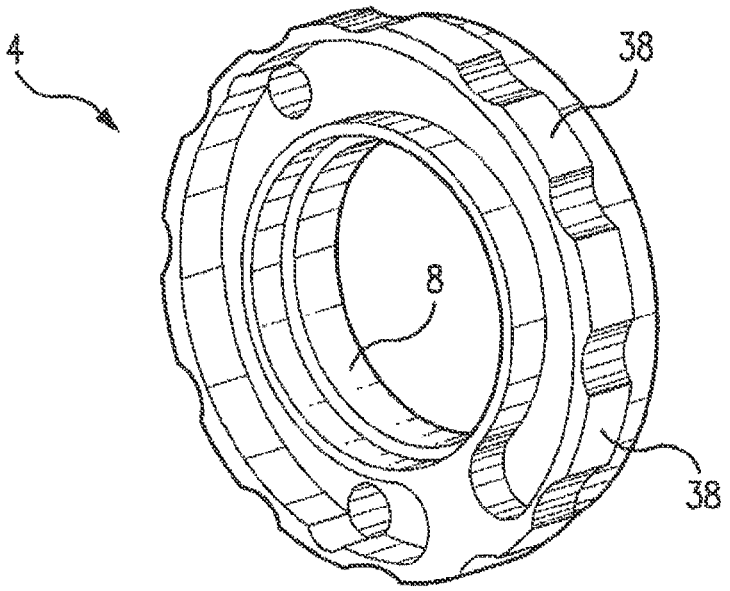
FIG. 6 is a full view of the bottom of adjustment assembly in perspective.

FIG. 6 shows the bottom 36 of the tool less adjustment assembly 4. The tool less adjustment assembly 4 rides on the roller bearing 8 of the assembly 4. The roller bearing 8 facilitates the ability of the tool less adjustment assembly to rotate in both a clockwise and counter clock wise direction for the adjustment of the torque level. The outside surface 38 of the adjustment assembly 4 is made to grip for easier rotation.

Figure 7:
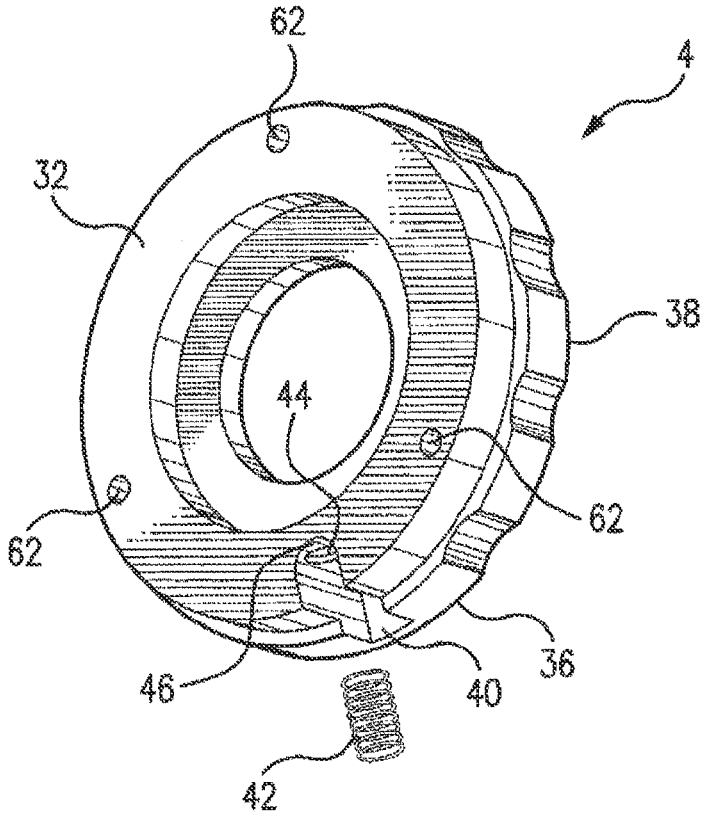
FIG. 7 is a full view in perspective of the adjustment assembly from the top.

FIG. 7 shows the top surface 32 of the tool less adjustment assembly 4. The top surface 32 and outside surface 38 have a slot 40 through the top surface 32 and into the outside surface 38 terminating near the bottom 36. This slot 40 contains the spring button. 20 and the spring 42. The slot 40 also has a circular depression 44 in its back 46 for receiving the spring 42. This slot 40 accepts the spring 42 and the spring button 20 and fits within the adjustment assembly 4. The spring 42 keeps a forward pressure on the spring button 20 against the inside of the housing 6.

The top surface 32 of assembly 4 has three openings therethrough 62 that secure the adjustable assembly 4 to the backing plate 60.

Figure 8:
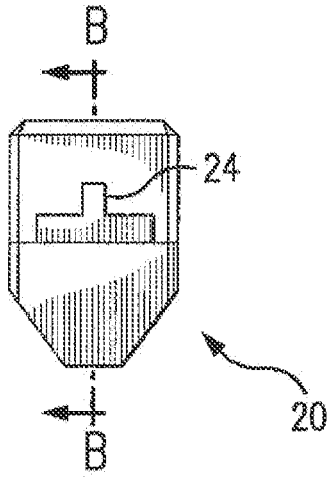
FIG. 8 is a full top view of the spring button showing the internal components in phantom.

FIG. 8 shows the line B-B through the spring button 20. The single tooth 24 is visible in phantom.

Figure 9:
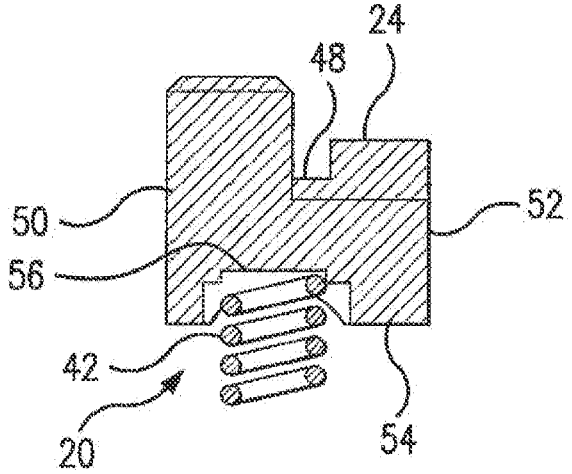
FIG. 9 is a full side view in cross section of the spring button taken through line B-B of FIG. 8.

FIG. 9 shows the section along line B-B. This figure shows the single tooth 24 integrated with the top surface of push button 20. Also shown is the first end 50, second end 52 and the back surface 54. The back surface 54 has a circular depression 56 that accepts the opposite end of the spring 42. This is how the spring 42 maintains its bias against the spring button 20 forcing the spring button against the inside surface 28 of the housing 6. The single tooth 24 of the spring button 20 integrates with the series of teeth 12 on the inside surface 28 of the housing 6. The user simply pushes the spring button 20 in, this disengages the single tooth 24 from the series of teeth 12 and the adjustment assembly 4 is rotated to increase or decrease torque and the spring button 20 is released locking the new torque setting without the use of tools and time consuming tear down.

Figure 10:
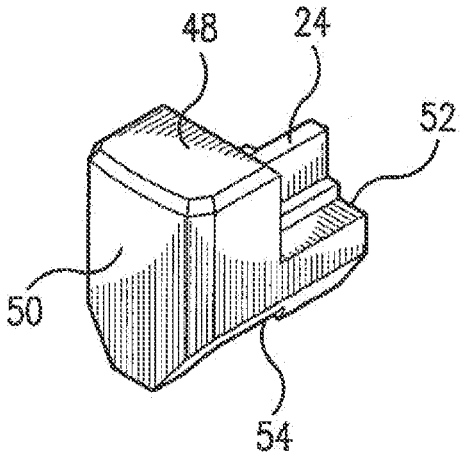
FIG. 10 is a full view in perspective of the spring button from the top.

FIG. 10 shows the spring button 20 from the side. The first end 50 faces upward as the second end 52 faces downward. The front 54 faces the back surface 46 of the slot 40. Here the circular depressions 44 of the adjustable assembly and he circular depression 56 of the spring button 20 align and retain the spring 42.

Figure 11:
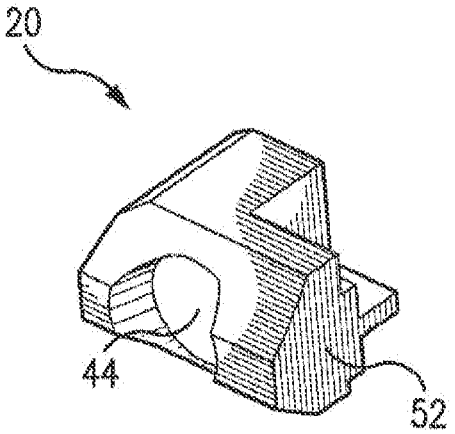
FIG. 11 is a full view in perspective of the spring button from the bottom.

FIG. 11 shows the spring button 20 from the second end 52. The circular depression 44 of the spring button 20 is visible.

What is claimed is:

1. A tool-less adjustment assembly for changing a torque setting on a bottle capping headset, said adjustment assembly comprising:

i. a housing, said housing having an outside edge with an inside surface, a portion of said inside surface having a series of teeth affixed thereon, there being a snap ring retainer located in said inside surface;

ii. a rotatable, backing plate surmounted on said snap ring;

iii. a rotatable, adjustable end plate detachedly mounted on said backing plate and under said snap ring;

iv. a witness mark located on said outside surface of said housing opposite said series of teeth;

v. an opening through. said rotatable, adjustable end plate, and contained in said opening, a spring biased button, said button having a back surface, there being at least a single tooth integrated with said back surface, said single tooth mating with said series of teeth and engaging said series of teeth to hold said series of teeth in a predetermined position when said button is released.

* * * * *